US005606763A

United States Patent [19]

South et al.

[11] Patent Number: 5,606,763

[45] Date of Patent: Mar. 4, 1997

[54] APPLICATOR FOR LIQUID FLOOR LEVELERS

[75] Inventors: Robert E. South; Steven J. Petty, both of Warsaw, Ind.

[73] Assignee: Midwest Rake Co., Winona Lake, Ind.

[21] Appl. No.: 589,174

[22] Filed: Jan. 19, 1996

[51] Int. Cl.[6] ..... B05C 17/00

[52] U.S. Cl. ..... 15/245.1; 15/235.8; 29/417

[58] Field of Search ..... 15/235.4, 235.8, 15/236.01, 236.09; 29/417; 118/110; 425/458

[56] References Cited

U.S. PATENT DOCUMENTS

| | | | |
|---|---|---|---|
| 1,399,381 | 12/1921 | Evans | 15/245.1 |
| 2,436,351 | 2/1948 | Bradley | 15/245.1 |
| 2,727,266 | 12/1955 | Smith et al. | 15/245.1 |
| 2,913,753 | 11/1959 | Peterson | 15/245.1 |
| 4,080,684 | 3/1978 | Venditti | 15/245.1 |
| 4,196,235 | 4/1980 | Lindqvist et al. | 15/245.1 |

FOREIGN PATENT DOCUMENTS

| | | | |
|---|---|---|---|
| 283458 | 1/1928 | United Kingdom | 15/236.01 |

*Primary Examiner*—Timothy F. Simone
*Assistant Examiner*—Terrence R. Till
*Attorney, Agent, or Firm*—Wendell E. Miller

[57] ABSTRACT

Apparatus (10) for applying floor coatings (11) in selectively predetermined thicknesses (12) includes an elongated handle (16) that is attached to an elongated spreader blade (13), a pair of cams (28 or 56) that are attached to ends (14A and 14B) of the spreader blade (13) by means of studs (26), so that the spreader blade (13) is suspended above a surface (53) of a floor (54) by cam-determined distances (52), and each stud (26) includes an indexing-shaped portion (36) that cooperates with an indexing-shaped hole (44 or 60) in the cams (28 or 56) to provide selective rotational indexing of the cams (28 or 56).

25 Claims, 2 Drawing Sheets

10
16
18
20
22
24
26
28
30
48
11
53
54
55
66
13
2
2

13
51
11
52
34
12

13
14A
28
30
53
54
4
4
18
11
33
16
22
20
12
10
3
3
14B
26
52

28
A2
46B
R8
R9
46C
50
48
44
R10
46D
R11
R12
46E
R7
R6
R5
47
46A
R4
F2
42
66

65D
A3
R17
62
R16
65C
58
56
65B
R18
F3
65E
R15
60
64
R14
65A
R13
66

30
40
28
36
14A
26
38
15
13
34

32
T3
L3
R3
L4
T5
R2
L2
A1
T2
T4
L5
34
14B
R1
F1
T1
L1

APPLICATOR FOR LIQUID FLOOR LEVELERS

BACKGROUND OF THE INVENTION

The present invention relates generally to applicators for applying liquid compounds to floors. More particularly, the present invention pertains to floor applicators with which epoxies and other materials are applied in selective thicknesses to floors of concrete and other materials.

FIELD OF THE INVENTION

Floors of concrete and other materials become cracked and worn, or may have uneven surfaces that are not appropriate for the use in a particular structure or for use in a particular room. In instances wherein a floor surface is inadequate for a particular use because of unevenness, roughness, or cracks, floor leveling materials, such as epoxies, may be applied in various thicknesses as needed to provide a new or renewed floor of vastly improved quality.

Typically, the floor leveling materials are poured onto the floors and leveled by hand-drawn levelers that consist of a transversely disposed spreader blade, a longitudinally disposed handle, and some device that serves to suspend the spreader blade above the floor surface by a selectively-adjustable distance.

A prior art device for suspending the spreader blade above the floor surface includes carbide pins that depend downwardly below the spreader blade. The use of carbide pins has two disadvantages. One disadvantage is that they frequently become caught in holes as the spreader is pulled across a cement surface, and being a brittle material, the carbide pins are easily and frequently broken. The other weakness of this prior art design is that the applied material varies in thickness with variations in inclination of the handle as held by the user.

SUMMARY OF THE INVENTION

In the present invention, apparatus is provided for applying floor coatings in selectively predetermined thicknesses. The apparatus includes an elongated handle, an elongated spreader blade of extruded aluminum with an indexing-shaped opening extending from one end to the other end thereof, and a pair of brackets that attach the handle to the blade by use of bolts.

A pair of threaded studs, each having an indexing-shaped portion, is inserted into respective ends of the spreader blade, and the indexing-shaped portions extend outwardly from respective ones of the ends. A pair of identical cams, each having an indexing-shaped hole, is slidably assembled onto the indexing-shaped portions of the studs, and hand-tightened nuts retain the cams.

The cams may be selectively assembled to the studs at rotational locations in accordance with the shape of the indexing-shaped portions. In the preferred embodiment, the indexing-shaped portions of the studs and the indexing-shaped holes of the cams are hexagonal, so the cams may be rotationally positioned at 60 degree increments. In cams using hexagonal holes, the cams include five lobes, each supporting the spreader blade a different distance above the floor surface, thereby providing for five different thicknesses of the floor covering material.

In a first aspect of the present invention, apparatus is provided for applying floor coatings in selectively predetermined thicknesses, which apparatus comprises an elongated handle; an elongated spreader blade having first and second ends; means for attaching the handle to the spreader blade with the spreader blade disposed transversely to the handle; means, including a pair of cams each being operatively attached proximal to one of the ends of the spreader blade, for suspending the spreader blade above a surface of a floor by a cain-determined distance; and means, including means for rotationally positioning the cams, for selectively changing the cam-determined distance.

In a second aspect of the present invention, a rotational-indexing cam is provided for use in spacing a spreader blade of a floor applicator above a surface of a floor by cam-determined distances, which cam comprises a cam body having all indexing axis; means, including a plurality of cam lobes being circumferentially disposed around the indexing axis, for providing a plurality of indexed distances from the indexing axis to the surface of the floor; and means, including a selected contour for each of the cain lobes, for maintaining at least three of the indexed distances within an average of 1.0 percent when the cam is rotationally positioned within plus or minus 10 degrees from any one of indexed rotational angles.

In a third aspect of the present invention, a rotational-indexing cam is provided for use in spacing a spreader blade of a floor applicator above a surface of a floor by cam-determined distances, which cam comprises a cam body having an indexing axis; means, including a plurality of cam lobes being circumferentially indexed around the indexing axis, for providing a plurality of indexed distances from the indexing axis to the surface of the floor; and means, including a selected contour for each of the cam lobes, for maintaining all of the indexed distances within 1.0 percent when the cam is rotationally positioned within plus or minus 10 degrees from respective ones of indexed rotational angles.

In a fourth aspect of the present invention, a rotational-indexing cam is provided for use in spacing a spreader blade of a floor applicator above a surface or a floor by cam-determined distances, which cam comprises a cam body having an indexing axis; means, including a plurality of cam lobes being circumferentially indexed around the indexing axis, for providing a plurality of indexed distances from the indexing axis to the surface of the floor; means, including an indexable part that is coaxial with the indexing axis, for rotationally indexing the cam; and means, including a selected contour for each of the cam lobes, for maintaining at least three of the indexed distances substantially constant when the cam is rotationally positioned within plus or minus 10 degrees from respective ones of indexed rotational angles.

In a fifth aspect of the present invention, a method is provided for making apparatus for applying floor coatings, which method comprises length-sizing an extrusion to make a spreader blade; attaching a handle to the spreader blade; attaching first and second cams to respective ends of the spreader blade; and providing for selective rotational positioning or the cams.

DESCRIPTION OF THE PREFERRED EMBODIMENTS

Figures 1, 2, 3:
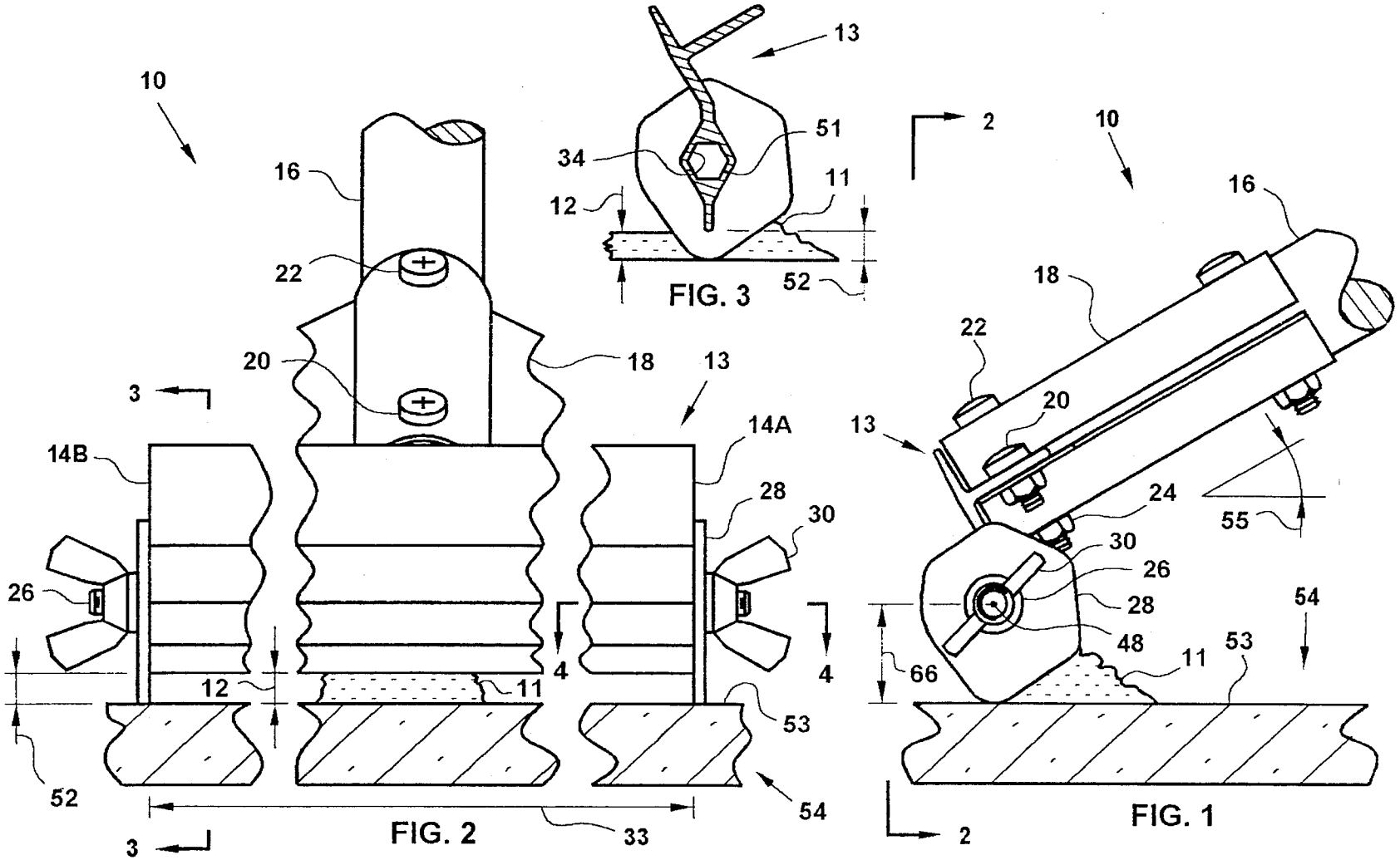
FIG. 1 is a side elevation of a preferred embodiment of the floor applicator with a portion of the handle broken away.
FIG. 2 is an end view of the floor applicator of FIG. 1, taken substantially as shown by View Line 2—2 of FIG. 1, with portions of the spreader blade broken out and a portion of the handle broken away.
FIG. 3 is a cross sectional view of the spreader of FIGS. 1 and 2, taken substantially as shown by Section Line 3—3 of FIG. 2, more clearly showing relationships between the cams and the spreader blade, as determined by the indexing-shaped opening in the spreader blade.
Figures 4, 5, 6, 7:
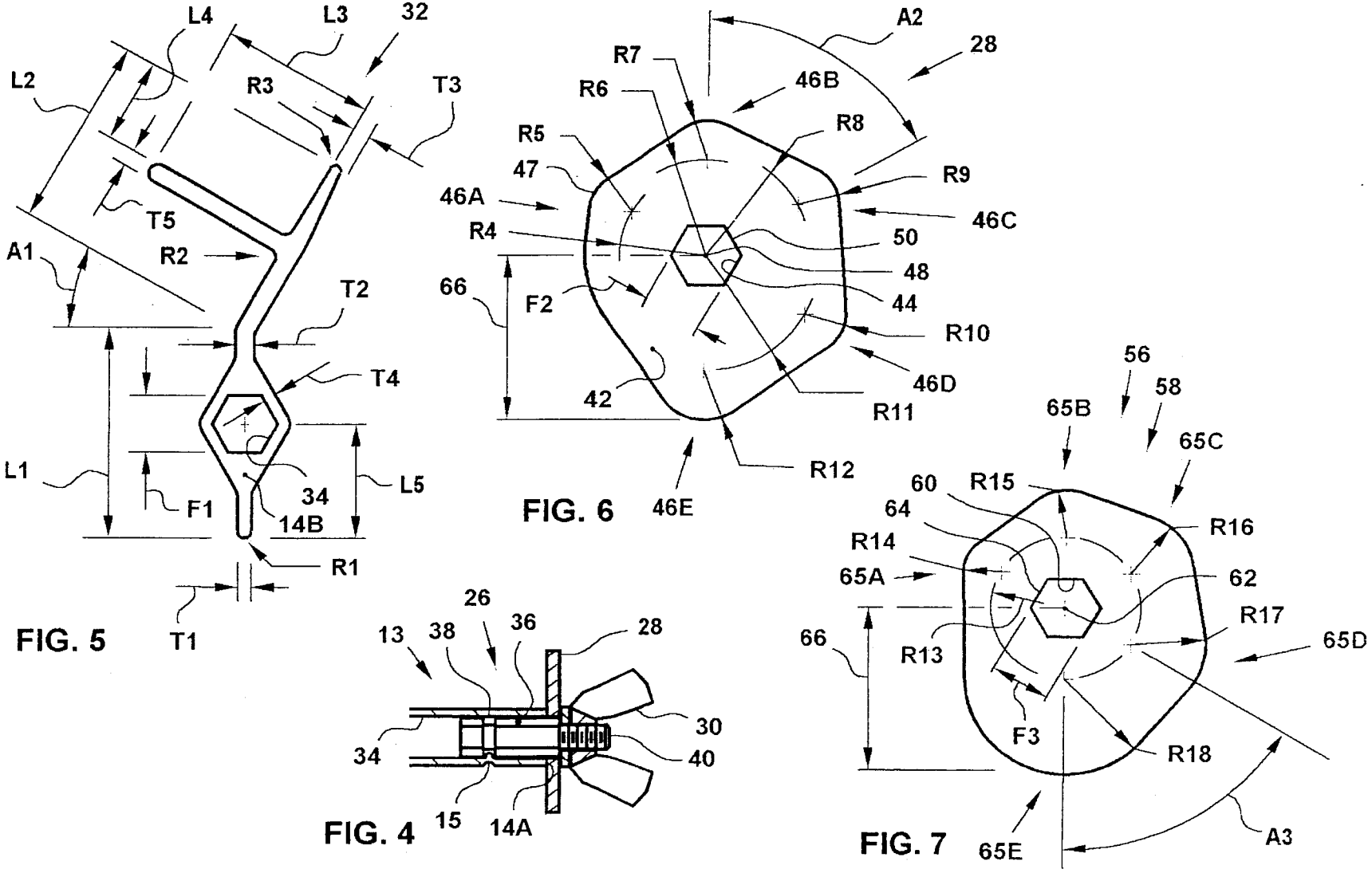
FIG. 4 is a partial cross section, taken substantially as shown by Section Line 4—4 of FIG. 2, showing one of the studs staked into the indexing-shaped opening of the spreader blade.
FIG. 5 is an end view of the extrusion from which the spreader blade is severed.
FIG. 6 is a cam for use with the floor applicator of FIGS. 1 and 2.
FIG. 7 is an alternate and preferred embodiment of a cam for use with the floor applicator of FIGS. 1 and 2.

Referring now to FIGS. 1 and 2, apparatus, or floor applicator, 10 for applying floor coatings, or spreadable material, 11 in selectively predetermined thicknesses, or floor coating thicknesses, 12 includes an elongated spreader blade 13 with ends 14A and 14B, staked portions 15 as shown in FIG. 4, an elongated handle 16, and a pair of identical handle-attaching brackets 18. Bolts 20 and 22, together with nuts 24, attach the handle 16 to the spreader blade 13. The apparatus 10 also includes a pair of identical studs 26 as more clearly shown in FIG. 4, a pair of identical, rotationally-positionable or indexable cams, or rotational-indexing cams, 28, and wing nuts, or hand-removable threaded retainers, 30.

The brackets 18 and their use for attaching the handle 16 to a transversely-disposed element, such as the spreader blade 13, are both fully described in U.S. patent application Ser. No. 08/433,775, filed May 3, 1995.

Referring to FIG. 5, the spreader blade 13 is cut or severed from an aluminum extrusion 32 of FIG. 5 to a length 33 of FIG. 2. The length-sized extrusion 32 then has the ends 14A and 14B which are the same as the ends 14A and 14B of the spreader blade 13. The extrusion 32 includes an indexing-shaped opening, or matching indexable part, 34 so that the spreader blade 13 also includes the indexing-shaped opening 34 as shown in FIG. 3. In the preferred configuration, as shown in FIGS. 3 and 5, the Indexing-shaped opening 34 is hexagonal.

Referring now to FIG. 4, each of the studs 26 includes an indexing-shaped portion or part, or matching indexable part, 36 that is interrupted by an annular staking groove, or reduced cross-sectional portion, 38, and the studs 26 each include a threaded portion 40. As shown in FIG. 4, the indexing-shaped portion 36 is inserted into the indexing-shaped opening 34, but the indexing-shaped portion 36 also extends outwardly from the ends 14A and 14B of the spreader blade 13.

Referring now to FIG. 6, the cams 28 each include a cam body 42, an indexing-shaped hole, or matching indexable part, 44, indexed rotational angles A2, and a plurality of cam lobes 46A–46E each of which has a selected contour 47. The lobes 46A–46E are rotationally-positioned around an indexing axis 48 to correspond with flats 50 of the indexing-shaped hole 44 that, in FIG. 6, is hexagonal. FIGS. 3 and 6 show the relationship between flats 51 of the indexing-shaped opening 34 of the spreader blade 13, the flats 50 of the indexing-shaped holes 44 of the cams 28, and the lobes 46A–46E.

Referring to FIG. 5, preferred dimensions of the extrusion 32 are as follows: angle A1=31 degrees, flat width F1=0.375 inches (9.53 nn), length L1=1.375 inches (34.93 mm), length L2=1.244 inches (31.60 mm). length L3=1.000 inches (25.40 mm), length L4=0.562 inches (14.27 mm), length L5=0.750 inches (19.05 mm), radius R1=0.045 inches (1.14 mm), radius R2=0.060 inches (1.52 mm), radius R3=0.030 inches (0.76 mm), thickness T1=0.090 inches (2.29 mm), thickness T2=0.125 inches (3.18 mm), thickness T3=0.125 inches (3.18 mm), thickness T4=0.080 inches (2.03 mm), and thickness T5=0.120 inches (3.05 mm).

Referring to FIG. 6, preferred dimensions for the cam 28 are as follows: indexed rotational angle A2=60 degrees, flat width F2=0.385 inches (9.78 mm), radius R4=0.562 inches (14.27 mm), radius R5=0.260 inches (6.60 mm), radius R6=0.625 inches (15.88 mm), radius R7=0.260 inches (6.60 mm), radius R8=0.688 inches (17.48 mm), radius R9=0.260 inches (6.60 mm), radius R10=0.260 inches (6.60 mm), radius R11=0.750 inches (19.05 mm), and radius R12=0.322 inches (8.18 mm).

Referring to FIG. 2, the cam 28 provides for five different floor coating thicknesses 12. These five thicknesses 12 are: 0.072 inches (1.83 mm); 0.135 inches (3.43 mm); 0.198 inches (5.03 mm); 0.260 inches (6.60 mm); and 0.322 inches (8.18 mm).

Preferably, the cam 28 is blanked from 12 gauge (2.66 mm) hot rolled steel, carbon nitrided to a depth of 2.0 millimeters, and hardened to Rc 62.

Referring now to FIGS. 1, 2, and 3, thicknesses, or cam-determined distances, or indexed distances, 52 from the spreader blade 13 to a surface 53 of a floor 54, as provided by the lobes 46A–46E of FIG. 6 may vary with variations in inclination of the handle 16 from a handle inclination angle, or design-selected angle, or nominal angle 55. Preferably, the nominal angle 55 is 31.0 degrees.

As can be seen In FIG. 3, the cam-determined distances 52 result in floor coating thicknesses 12 that are substantially equal to the cam-determined distances 52. That is, the cam-determined distances 52 are spaces between the blade 13 and the surface 53 of FIG. 2, whereas the floor coating thicknesses 12 refer to thicknesses of the spreadable material 11.

Referring to the cam 28 of FIGS. 1, 2, and 6, variations in inclination of the handle 16 from the nominal angle 55 by plus or minus 10 degrees results in changes in the cam-determined distances 52 as follows: lobe 46A, plus 0.010 inches (0.25 mm); lobe 46B, plus 0.004 inches (0.10 mm); lobe 46C, plus 0.001 inches (0.03 mm); lobe 46D, 0.0 inches (0.0 mm); and lobe 46E, 0.0 inches (0.0 mm). The average deviation in the cam-determined distances 52 for all five lobes, 46A–46E, is 0.003 inches (0.08 mm). Excluding the lobe 46A, the average deviation in the cam-determined distances 52 produced by the lobes 46B–46E is only 0.0013 inches (0.03 mm), and the lobes 46D and 46E do not produce any deviation in the cam-determined distances 52 when the handle inclination angle 55 is varied plus or minus 10 degrees.

The lobes 46D and 46E provide constant distances 52 between the spreader blade 13 and the surface 53 because the lobes 46D and 46E have radii R10 and R12 that are equal to the distances, or thicknesses, 52. That is, the length L5 of FIG. 5 is 0.750 inches (19.05 mm) and the radius R11 of FIG. 6 is also 0.750 inches (19.05 mm). Therefore, the radii R10 and R12 are equal to the thicknesses 52 that are produced by the lobes 46D and 46E, so the thicknesses 52 are maintained constant with changes in the inclination angle 55 of the handle 16 far beyond 10 degrees.

Referring now to FIG. 7, an alternate rotationally-positionable or indexable cam, or rotational-indexing cam, 56 which is also a preferred embodiment for use with the apparatus of FIGS. 1 and 2, includes a cam body 58, an indexing-shaped hole, or matching indexable part, 60 with an indexing axis 62, flats 64 of the indexing-shaped hole 60, and cam lobes 65A–65E. As shown in FIG. 7, preferably the indexing-shaped hole 60 is hexagonal in shape.

The lobes 46A–46E of FIG. 6 and the lobes 65A–65E of FIG. 7 provide indexed distances 66 from respective ones of the lobes 46A–46E and 65A–65E to the indexing axis 48 or 62. As shown in FIG. 1, the indexed distances 66 are also the distances from the indexing axis 48 to the surface 58 of the floor 54.

Whereas the cam 28 of FIG. 6 provides distances 52 of FIG. 3 and produces coating thicknesses 12 In a range that includes 0.072 inches (1.83 mm) and 0.322 inches (8.18 mm), cam lobes 65A–65E of the cam 56 provide distances 52 and produce coating thicknesses 12 of: 0.375 inches (9.53 mm); 0.500 inches (12.70 mm); 0.625 inches (15.88 mm); 0.750 inches (19.05 mm); and 1.00 inches (25.40 mm).

Referring to FIGS. 1, 8, 5, and 7, dimensions of the cam 56 are as follows: indexed rotational angle A3=60 degrees, flat width F3=0.385 inches (9.78 mm). radius R13=0.750 inches (19.05 mm), radius R14=0.375 inches (9.53 mm), radius R15=0.500 inches (12.70 mm), radius R16=0.625 inches (15.88 mm), radius R17=0.750 inches (19.05 mm), and radius R18=1.000 inch (25.40 mm).

Since the radius R13 is equal to the length L5 of the spreader blade 18, and since the radii R14–R18 of all of the lobes 65A–65E are equal to the distances 52 and thicknesses 12 that they produce, the cam 56 produces distances 52 and thicknesses 12 that remain constant for changes in the inclination angle 55 of the handle 16 by far greater variations than plus and minus 10 degrees.

Even for extremely tall men and extremely short men, the chances of the apparatus 10 being used with handle inclination angles 55 deviating more than 10 degrees from the nominal angle 55 of 31 degrees, are highly unlikely. Therefore, the apparatus 10, when used with either the cam 28 of FIG. 6, or the cam 56, will produce coating thicknesses 12 that are either totally independent of changes in the handle inclination angle 55, or that are relatively insensitive to changes in the angle 55.

Referring now to FIG. 2, the brackets 18 provide means for attaching the handle 16 to the spreader blade 13 with the spreader blade 13 disposed transversely to the handle 16. The cams, 28 or 56, provide means for suspending the spreader blade 13 above the surface 53 of the floor 54 by a cam-determined distance 52. The indexing-shaped portions 36 of the studs 26 of FIG. 4 and the indexing-shaped holes, 44 and 60, of the cams, 28 and 56 of FIGS. 6 and 7, provide means for rotationally positioning the cams, 28 and 56, and the lobes 46A–46E and 65A–65E of the cams, 28 and 56, provide means for selectively changing the cam-determined distances 52 and the thicknesses 12.

Referring to FIGS. 2 and 5–7, a method for making the apparatus 10 for applying floor coatings 11 includes length-sizing the extrusion 32 to make the spreader blade 13, attaching the handle 16 to the spreader blade 13, attaching the cams 28 or 56 to the respective ends 14A and 14B of the spreader blade 13, and providing for selective indexing of the cams 28 or 56. Preferably, the method further comprises making the radii, R5, R7, R9, R10, and R12 of the lobes 46A–46E, or R14–R18 of the lobes 65A–65E, substantially equal to the coating thickness 12 produced by that lobe, 46A–46E or 65A–65E.

A method for applying floor coatings 11 In the selectively predetermined thicknesses 12 includes indexing a pair of the cams 28 or 56 to select the distance 52 between the spreader blade 13 and the surface 53 of the floor 54, applying the spreadable material 11 to the floor surface 53, and spreading the material 11 a predetermined thickness 12 by moving the spreader blade 13 to spread the material 11.

In summary, the present invention provides apparatus 10 in which rotationally-positionable or indexable cams, 28 or 56, provide an easy and precise method of adjusting for different thicknesses 12 of coatings 11, and the lobes 46A–46E or 65A–65E tend to slide over holes in cement floors, rather than be caught in the holes, as do carbide pins; provide large wear areas so that nitrided surfaces, which are less expensive than carbide wear surfaces, provide excellent service life; and achieve substantially uniform coating thicknesses 12 irrespective of the inclination angle 55 of the handle 16.

While specific apparatus and method have been disclosed in the preceding description, and while part numbers have been inserted parenthetically into the claims to facilitate understanding of the claims, it should be understood that these specifics have been given for the purpose of disclosing the principles of the present invention and that many variations thereof will become apparent to those who are versed in the art. Therefore, the scope of the present invention is to be determined by the appended claims, and without any limitation by the part numbers inserted parenthetically in the claims.

Industrial Applicability

The present invention is applicable to applying industrial coatings for smoothing and/or leveling floors, to spreading any material, fluid, granulated, or powered, In selected thicknesses, and to mixing dry or fluid materials by raking.

What is claimed is:

1. Apparatus (10) for applying floor coatings (11) in selectively predetermined thicknesses (12), which apparatus comprises:

an elongated handle (16);

an elongated spreader blade (13) having first (14A) and second (14B) ends;

means (18) for attaching said handle to said spreader blade with said spreader blade disposed transversely to said handle;

means, comprising a pair of cams (28 or 56) each being operatively attached proximal to one (14A or 14B) of said ends of said spreader blade, for suspending said spreader blade above a surface (53) of a floor (54) by a cam-determined distance (52); and means, comprising means (36, and 44 or 60) for rotationally positioning said cams, for selectively changing said cam-determined distance.

2. Apparatus (10) as claimed in claim 1 in which said means for rotationally positioning said cams (28 or 56) comprises means (36, and 44 or 60) for rotationally indexing said cams to selected ones of a plurality of indexed rotational angles (A2 or A3).

3. Apparatus (10) as claimed in claim 2 in which said cams (28 or 56) include means, comprising a plurality of lobes (46A–46E or 65A–65E), for maintaining said cam-determined distances (52) within an average of 1.0 percent when said cams are indexed to any of said indexed rotational angles (A2 or A3), and when said handle (16) is inclined plus or minus 10 degrees from a design-selected angle (55).

4. Apparatus (10) as claimed in claim 2 in which said cams (28 or 56) include means, comprising a plurality of lobes (46A–46E or 65A–65E), for maintaining all of said cam-determined distances (52) within 1.0 percent when said cams are indexed to said indexed rotational angle (A2 or A3) and said handle (16) is inclined plus or minus 10 degrees from a design-selected angle (55).

5. Apparatus (10) as claimed in claim 2 in which said cams (28 or 56) include means, comprising a plurality of lobes (46A–46E or 65A–65E), for maintaining said cam-determined distances (52) substantially constant when said handle (16) is inclined plus or minus 10 degrees from a design-selected angle (55).

6. Apparatus (10) as claimed in claim 1 in which said operative attachment of said cams (28 or 56) comprises means (30 and 40) for removably attaching said cams; and said means for rotationally positioning said cams comprises said means for removably attaching said cams.

7. Apparatus (10) as claimed in claim 1 in which said operative attachment of said cams (28 or 56) to said ends (14A and 14B) of said spreader blade (13) comprises means (30 and 40) for removably attaching said cams to said spreader blade; and said means for rotationally positioning said cams comprises said means for attaching said cams to said ends of said spreader blade at selected ones of a plurality of indexed rotational angles (A2 or A3).

8. Apparatus (10) as claimed in claim 1 in which said operative attachment of said cams (28 or 56) to said ends (14A and 14B) of said spreader blade (13) comprises a stud (26) having an indexing-shaped portion (36) that extends outwardly from one (14A) of said ends of said spreader blade and another stud (26) having said indexing-shaped portion (36) that extends outward from the other (14B) of said ends of said spreader blade;

said cams each include an indexing-shaped hole (44 or 60); and said rotational positioning comprises said indexing-shaped portions and said indexing-shaped holes.

9. Apparatus (10) as claimed in claim 8 in which said indexing-shaped portions (36) and said indexing-shaped holes (44 or 60) are polygonal.

10. Apparatus (10) as claimed in claim 8 in which said indexing-shaped portions (36) and said indexing-shaped holes (44 or 60) are hexagonal.

11. Apparatus (10) as claimed in claim 1 in which said spreader blade (13) comprises an extrusion (32) with an indexing-shaped opening (34) that extends through said extrusion from a first end (14A) to a second end (14B); and said operative attachment of said cams (28 or 56) to said ends of said spreader blade comprises a pair of studs (26) having indexing-shaped portions (36) and being inserted into respective ones of said ends of said spreader blade.

12. Apparatus (10) as claimed in claim 1 in which said spreader blade (13) comprises an extrusion (32) with an indexing-shaped opening (34) that extends through said extrusion from a first end (14A) to a second end (14B);

said operative attachment of said cams (28 or 56) to said ends of said spreader blade comprises a pair of studs (26) having indexing-shaped portions (36) and being inserted into respective ones of said ends of said spreader blade; and said means for rotationally positioning said cams comprises said indexing-shaped portions.

13. Apparatus (10) as claimed in claim 1 in which:

said spreader blade (13) comprises an extrusion (32) having an indexing-shaped opening (34) that extends through said extrusion from one end (14A) to another end (14B);

said apparatus comprises a pair of studs (26) having indexing-shaped portions (36), being inserted into respective ones of said ends (14A and 14B) of said extrusion, and extending outward from said respective ends;

said cams (28 or 56) each include an indexing-shaped hole (44 or 60);

said operative attachment of said cams comprises said indexing-shaped opening, said indexing-shaped portions, and said indexing-shaped holes; and said means for rotationally positioning said cams comprises said indexing-shaped portions and said indexing-shaped holes.

14. Apparatus (10) as claimed in claim 13 in which said operative attachment of said cams (28 or 56) to said ends (14A and 14B) of said spreader blade (13) further comprises:

a threaded portion (40) of said studs (26); and a pair of hand-removable threaded retainers (30) that threadingly engage respective ones of said threaded portions.

15. Apparatus (10) as claimed in claim 13 in which said indexing-shaped opening (34), said indexing-shaped portions (36), and said indexing-shaped holes (44 or 60) are all polygonal.

16. Apparatus (10) is claimed in claim 13 in which said studs (26) each include a reduced cross-sectional portion (38);

said apparatus includes means, comprising said reduced cross-sectional portions and stacked portions (15) of said spreader blade (13), for retaining said studs within said indexing-shaped opening (34).

17. A rotational-indexing cam (28 or 56) for use in spacing a spreader blade (13) of a floor applicator (10) above a surface (53) of a floor (54) by cam-determined distances (52), which cam comprises:

a cam body (42 or 58) having an indexing axis (48 or 62);

means, comprising a plurality of cam lobes (46A–46E or 65A–65E) being circumferentially disposed around said indexing axis, for providing a plurality of indexed distances (66) from said indexing axis to said surface of said floor; and means, comprising a selected contour (47) for each of said cam lobes, for maintaining at least three of said indexed distances within an average of 1.0 percent when said cam is rotationally positioned within plus or minus 10 degrees from any one of indexed rotational angles (A2 or A3).

18. A rotational-indexing cain (28 or 56) for use in spacing a spreader blade (13) of a floor applicator (10) above a surface (53) of a floor (54) by cam-determined distances (52), which cain comprises:

a cain body (42 or 58) having an indexing axis (48 or 62);

means, comprising a plurality of cam lobes (46A–46E or 65A–65E) being circumferentially indexed around said indexing axis, for providing a plurality of indexed distances (66) from said indexing axis to said surface of said floor; and means, comprising a selected contour (47) for each of said cam lobes, for maintaining all of said indexed distances within 1.0 percent when said cam is rotationally positioned within plus or minus 10 degrees from respective ones of indexed rotational angles (A2 or A3).

19. A rotational-indexing cam (28 or 56) for use in spacing a spreader blade (13) of a floor applicator (10) above a surface (53) of a floor (54) by cam-determined distances (52), which cam comprises:

a cam body (42 or 58) having an indexing axis (48 or 62);

means, comprising a plurality of cam lobes (46A–46E or 65A–65E) being circumferentially indexed around said indexing axis, for providing a plurality of indexed distances (66) from said indexing axis to said surface of said floor;

means, comprising an indexable part (44) that is coaxial with said indexing axis, for rotationally indexing said cam; and means, comprising a selected contour (47) for each of said cam lobes, for maintaining at least three of said indexed distances substantially constant when said cam is rotationally positioned within plus or minus 10 degrees from respective ones of indexed rotational angles (A2 or A3).

20. A method for making apparatus for applying floor coatings, which method comprises:

a) length-sizing an extrusion to make a spreader blade;

b) attaching a handle to said spreader blade;

c) attaching first and second cams to respective ends of said spreader blade to raise the spreader blade above a floor; and rotationally positioning said cams with respect to said ends of said scraper blade.

21. A method as claimed in claim 20 in which said rotationally positioning step comprises providing for selective indexing of said cams.

22. A method as claimed in claim 21 in which:

a) said method further comprises forming a length of an extrusion that includes an indexing-shaped opening therethrough;

b) said length-sizing step comprises severing said length of said extrusion; and c) said attaching step comprises inserting first and second indexing-shaped parts into said indexing-shaped opening proximal to respective ends of said length-sized extrusion.

23. A method as claimed in claim 21 in which:

a) said method further comprises forming a length of an extrusion that includes an indexing-shaped opening therethrough;

b) said length-sizing step comprises severing said length of said extrusion; and c) said step of attaching said cams and said selective indexing of said cams both comprise inserting first and second indexing-shaped parts into said indexing-shaped opening proximal to respective ends of said length-sized extrusion.

24. A method as claimed in claim 23 in which said selective indexing further comprises:

a) forming an indexing-shaped hole in both of said cams; and b) selectively indexing said cams with respective ones of said indexing-shaped parts.

25. A method as claimed in claim 20 in which said rotationally positioning step comprises providing matching indexing parts and selective indexing of said matching indexable parts.

* * * * *

UNITED STATES PATENT AND TRADEMARK OFFICE

CERTIFICATE OF CORRECTION

PATENT NO. : 5,606,763

DATED : Mar. 4, 1997

INVENTOR(S) : Robert E. South et al.

It is certified that error appears in the above-indentified patent and that said Letters Patent is hereby corrected as shown below:

In column 2, "all" should be --an-- in line 14; "cain" should be --cam-- in line 18; "or" should be --of-- in line 39; and "or" should be --of-- in line 58. In column 5, "58" should be --53-- in line 13; "8" should be --3-- in line 22; and "18" should be --13-- in line 30. In Claim 16, "is" should be --as-- in line 29; --and-- should be inserted after the semicolon in line 31; and "stacked" should be --staked-- in line 33. In Claim 18, "cain" should be --cam-- in line 52; "cain" should be --cam-- in line 55; and "cain" should be --cam-- in line 56. In Claim 20, --d)-- should be inserted before "rotationally" and should start a separate paragraph, in line 27.

Signed and Sealed this

Seventh Day of October, 1997

*Attest:*

Bruce Lehman

BRUCE LEHMAN

*Attesting Officer*

*Commissioner of Patents and Trademarks*